US006464256B1

(12) United States Patent
Edwards

(10) Patent No.: US 6,464,256 B1
(45) Date of Patent: Oct. 15, 2002

(54) FURNITURE SLIDE

(76) Inventor: Donald V. Edwards, 17 Edna Rd., Adamsburg, PA (US) 15611

( * ) Notice: Subject to any disclaimer, the term of this patent is extended or adjusted under 35 U.S.C. 154(b) by 0 days.

(21) Appl. No.: 09/659,704

(22) Filed: Sep. 11, 2000

(51) Int. Cl.[7] ..... A47B 91/06
(52) U.S. Cl. ..... 280/845; 280/28.17; 16/42 R
(58) Field of Search ..... 280/845, 19, 28.17, 280/842, 602, 18, 18.1, 23.1, 28.13, 5.24; 16/42 R; 472/88, 90; 248/346.11, 188.9

(56) References Cited

U.S. PATENT DOCUMENTS 1,861,095 A * 5/1932 Schaht ..... 16/42 R X
3,326,508 A * 6/1967 Born ..... 248/346.11
5,220,705 A 6/1993 Bushey ..... 16/42 R
5,469,599 A * 11/1995 Wurdack ..... 16/42 R X
5,557,824 A * 9/1996 Bushey ..... 16/42 R
5,802,669 A * 9/1998 Wurdack ..... 16/42 R
5,803,478 A * 9/1998 Gavalis ..... 280/602 X
5,823,562 A * 10/1998 Stubblefield ..... 280/602 X
5,984,343 A * 11/1999 Longoni et al. ..... 280/602
5,984,360 A 11/1999 Edwards et al. ..... 280/845
6,206,424 B1 * 3/2001 Edwards et al. ..... 280/845

* cited by examiner

*Primary Examiner*—Robert P. Olszewski
*Assistant Examiner*—F. Zeender
(74) *Attorney, Agent, or Firm*—Carothers & Carothers

(57) ABSTRACT

A furniture slide for placement between an object to be moved and flooring over which it is to be moved, which includes a sheet of flexible material having top and bottom faces and complex curvature on the bottom face with a concave curvature along the longitudinal axis thereof and a convex curvature along the transverse axis thereof. A compressible material is adhered to the top face for support contact with an object to be moved.

3 Claims, 2 Drawing Sheets

FURNITURE SLIDE

BACKGROUND OF THE INVENTION

The present invention pertains to furniture slides for efficiently moving furniture or other heavy objects across a floor. The invention particularly pertains to multiple furniture slides that are used in cooperation with one another.

Various prior art devices have been suggested for placing under the legs of furniture or placing under the furniture itself in order to move the furniture across a floor surface. A good example is U.S. Pat. No. 5,984,360 entitled FURNITURE SLIDE AND METHOD OF USE. The present invention pertains to an improvement in this device.

One problem encountered with such furniture slides is that they tend to come off or dislodge themselves from the bottom of the furniture legs when the furniture is being moved. It is a principal object of the present invention to provide a furniture slide which enhances the capability of the furniture slide to stay with the furniture being moved.

SUMMARY OF THE INVENTION

The furniture slide of the present invention is designed for placement between an object to be moved and flooring over which it is to be moved, and it is comprised of a sheet of material having top and bottom faces and complex curvature providing the bottom face with a concave curvature along a longitudinal axis thereof and a convex curvature along a transverse axis thereof. Compressible material is adhered to the top face of the sheet for support contact with an object to be moved.

The sheet is preferably constructed of plastic and provided with upturned perimeter edges to assist in its ability to glide over a floor surface.

The complex curvature provides a continuous upward pressure on the furniture being carried by the slide at all times and this feature greatly helps to prevent the furniture slides from coming off or dislodging.

BRIEF DESCRIPTION OF THE DRAWINGS

Other objects and advantages appear hereinafter in the following description and claims. The accompanying drawings show, for the purpose of exemplification, without limiting the invention or the appended claims, certain practical embodiments of the present invention wherein:

DETAILED DESCRIPTION OF A PREFERRED EMBODIMENT

Figure 1:
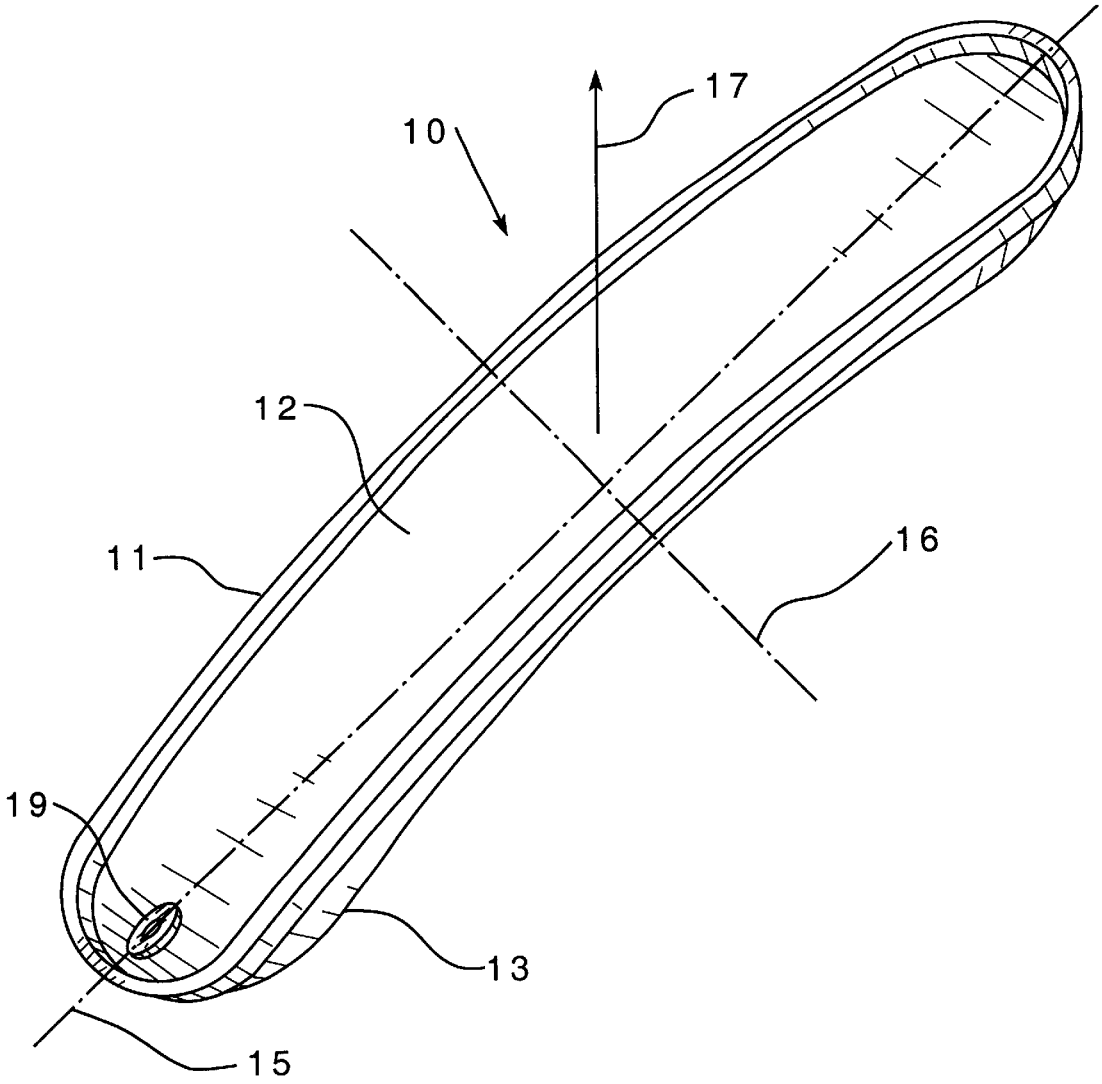
FIG. 1 is a perspective view of the furniture slide of the present invention with the compressible material normally adhered to the top thereof removed.
Figure 2:
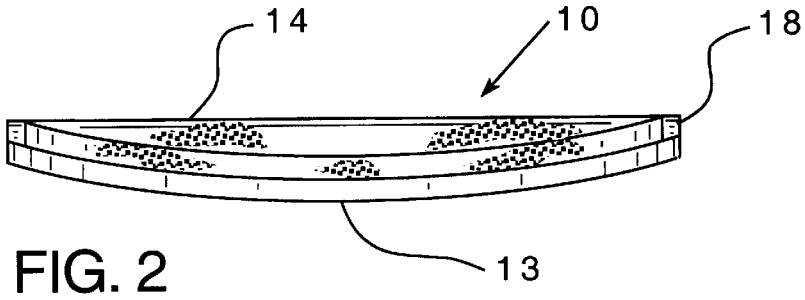
FIG. 2 is a view in front elevation of the furniture slide shown in FIG. 1.
Figure 3:
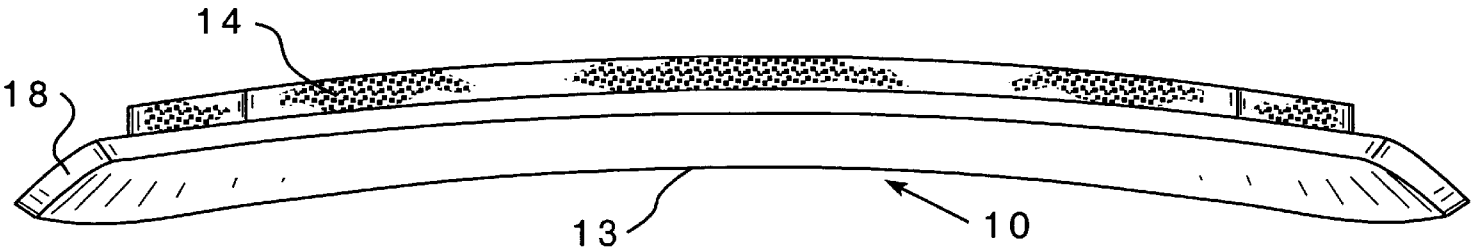
FIG. 3 is a view in side elevation of the furniture slide shown in FIG. 1.
Figure 4:
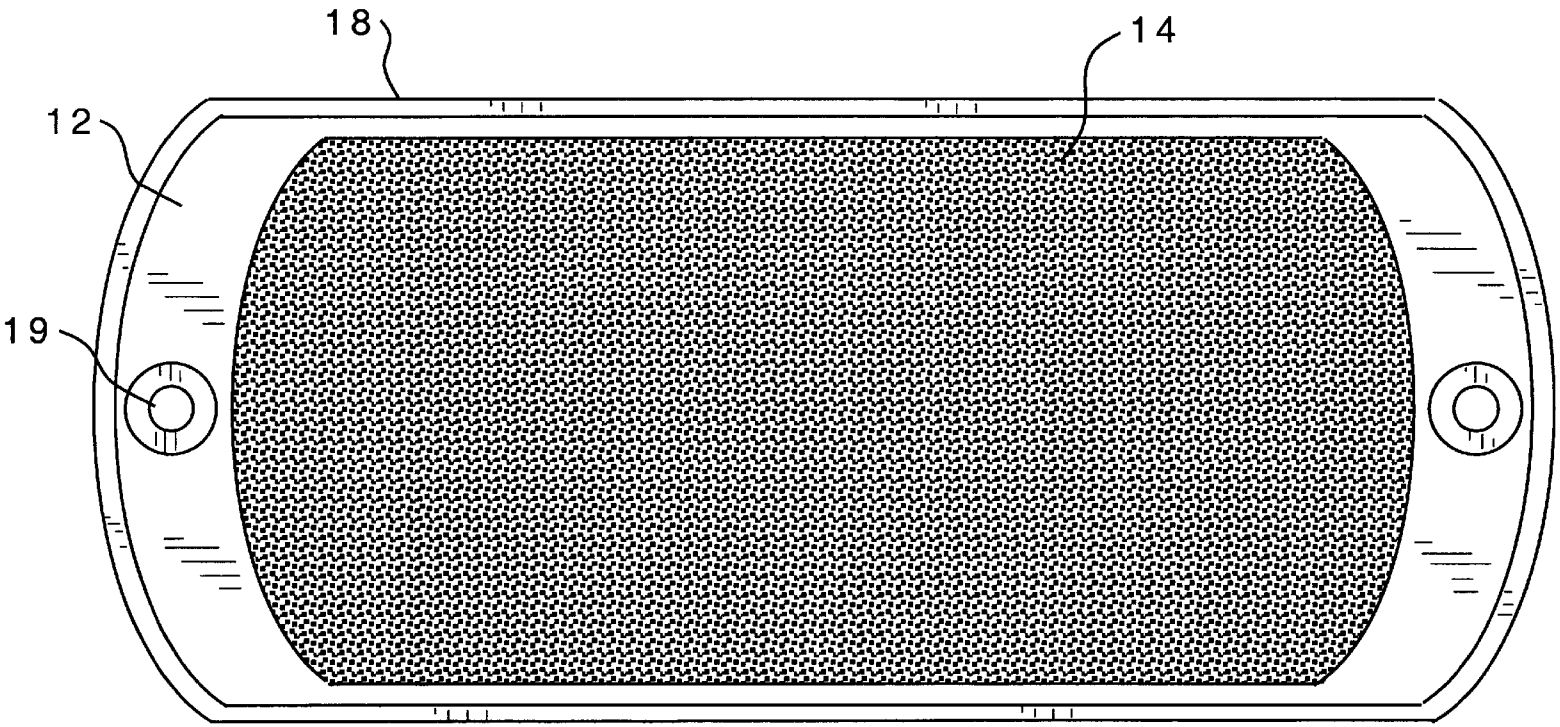
FIG. 4 is a top or plan view of the furniture slide shown in FIG. 1.

Referring to the drawings, the furniture slide 10 of the present invention is designed for placement between an object to be moved (not shown) and flooring (not shown) over which it is to be moved. Furniture slide 10 is comprised of a flexible plastic sheet 11 having top and bottom faces 12 and 13 respectively. A compressible material 14 is adhered to the top face 12 for support contact with an object to be moved. In FIG. 1, this compressible material 14 is not shown in order to more readily reveal the complex curvature provided in the bottom face 13 in sheet 11.

This complex curvature includes a concave curvature along longitudinal axis 15 and a convex curvature along transverse axis 16 of the bottom face 13.

This complex curvature in the bottom face 13 continuously provides an upward pressure as indicated by arrow 17 against any furniture which is placed thereon due to the complex curvature and the flexibility of sheet 11. This continually urges compressible material 14 upwardly against the bottom of a piece of furniture (not shown) positioned thereon to help prevent dislodgment of the slide 10 when the furniture is being moved across a floor surface.

The sheet 11 is further provided with an upturn perimeter edge 18 which assists in the gliding of the slide 10 across a floor surface without catching on objects here. A reinforced opening 19 is also provided on one end of the sheet 11 for hanging the slide on a wall surface or for attaching a line.

I claim:

1. A slide for placement between a detached object to be moved and flooring over which it is to be moved which comprises:

a flexible sheet of material having top and bottom faces and said bottom face having a concave curvature along a longitudinal axis thereof and a convex curvature along a transverse axis thereof; and a compressible material adhered to said top face for supportive contact with the object to be moved.

2. The slide of claim 1 wherein said sheet is plastic.

3. The slide of claim 1 wherein said sheet has an upturned perimeter edge.

* * * * *